United States Patent [19]

Sartor

[11] Patent Number: 4,769,929

[45] Date of Patent: Sep. 13, 1988

[54] REAR-ENTRY SKI BOOT WITH A CLOSURE AND FLEXIBILITY ADJUSTMENT DEVICE

[75] Inventor: Mariano Sartor, Montebelluna, Italy

[73] Assignee: Nordica S.p.A., Montebelluna, Italy

[21] Appl. No.: 33,362

[22] Filed: Apr. 2, 1987

[30] Foreign Application Priority Data

Apr. 9, 1986 [IT] Italy ..... 20013 A/86

[51] Int. Cl.[4] ..... A43B 5/04; A43C 11/00

[52] U.S. Cl. ..... 36/117; 36/50; 36/120

[58] Field of Search ..... 36/117–121, 36/105, 50

[56] References Cited

U.S. PATENT DOCUMENTS

| | | | |
|---|---|---|---|
| 4,083,129 | 4/1978 | Collombin et al. | 36/117 |
| 4,281,468 | 8/1981 | Giese et al. | 36/121 |
| 4,596,080 | 6/1986 | Benoit et al. | 36/120 |
| 4,620,379 | 11/1986 | Sartor | 36/50 X |

FOREIGN PATENT DOCUMENTS

| | | | |
|---|---|---|---|
| 2522968 | 1/1977 | Fed. Rep. of Germany | 36/117 |

*Primary Examiner*—James Kee Chi

*Attorney, Agent, or Firm*—Guido Modiano; Albert Josif

[57] ABSTRACT

The present invention relates to a rear-entry ski boot with a closure and flexibility adjustment device which includes a shell to which a rear quarter and a front quarter, mutually closeable on each other, are pivotably coupled. The peculiarity of the invention resides in the fact that it includes closure elements for the mutual tightening of the quarters adapted to act, at the same time, as flexibility adjusters. The closure elements consist of a lever supported by the rear quarter and acting on a cable which embraces the front quarter, with the interposition of a device for adjusting the useful length of the cable. The cable is removably accommodatable in notches provided transversely with respect to a slot defined at the front top edge of the front quarter and extending longitudinally on the front quarter.

15 Claims, 1 Drawing Sheet

REAR-ENTRY SKI BOOT WITH A CLOSURE AND FLEXIBILITY ADJUSTMENT DEVICE

BACKGROUND OF THE INVENTION

The present invention relates to a rear-entry ski boot with a closure and flexibility adjustment device.

As is known, ski boots are currently available on the market in which the adjustment of the flexibility is performed by means of a slot provided on the quarter and provided with means which perform a progressive closure of the flaps, so as to vary the rigidity of the quarter and, accordingly, the characteristics of flexibility.

Among these solutions, U.S. Pat. No. 4,030,214 is mentioned, wherein a slot is provided which is delimited by protruding flaps both in the front part of the shell and in the rear part of the quarter which is progressively closed by a slideable cursor.

In this type of device, remarkable difficulties are generally encountered in the precise fixing of the cursor, which furthermore requires complicated manoeuvers on the part of the user.

Another solution is described in French Pat. No. 2345960, wherein a band is provided which can be arranged at the top end of the quarter and tightened so as to close one or more openings of slots defined at the upper flap.

This form of embodiment has the disadvantage of a difficult coupling of the band of the quarter and a closing action which can only be performed in discrete points, with the consequent difficulty of effecting a precise adjustment.

SUMMARY OF THE INVENTION

The aim proposed by the invention is indeed to eliminate the above described disadvantages by providing a rear-entry ski boot wherein the adjustment of the flexibility can be performed with great speed and ease, without the need to use elements provided separately or separable from the boot.

Within the scope of the above described aim, a particular object of the invention is to provide a rear-entry ski boot in which it is also possible to obtain the extremely rapid and easy closure of the quarters of the boot, furthermore with the possibility of easily recovering the cable used to close the quarters.

Still another object of the present invention is to provide a ski boot in which the operation, both of tightening of the quarters and of adjusting the flexibility, can be achieved rapidly and easily.

Not a least object of the present invention is to provide a ski boot which is easily obtainable from elements and materials commonly available on the market and which is furthermore advantageous from a purely economical point of view.

The above described aim, as well as the objects mentioned and others which will become apparent hereinafter, are achieved by a rear-entry ski boot with a closure and flexibility adjustment device, comprising a shell to which a rear quarter and a front quarter, mutually closeable on each other, are pivotably coupled, characterized in that it comprises closure means for the mutual tightening of said quarters adapted for acting simultaneously also as flexibility adjusters.

BRIEF DESCRIPTION OF THE DRAWINGS

Further characteristics and advantages will become apparent from the description of a preferred, but not exclusive, embodiment of a rear-entry ski boot with closure and flexibility adjustment device, illustrated only by way of non-limitative example in the accompanying drawings, wherein.

DESCRIPTION OF THE PREFERRED EMBODIMENTS

Figure 2:
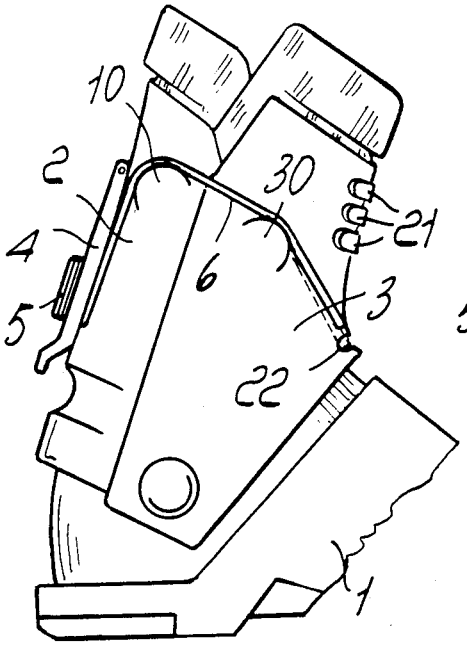
FIG. 2 is a view of the ski boot with the closure means positioned for maximum flexibility with recovery of the cable.
Figure 1:
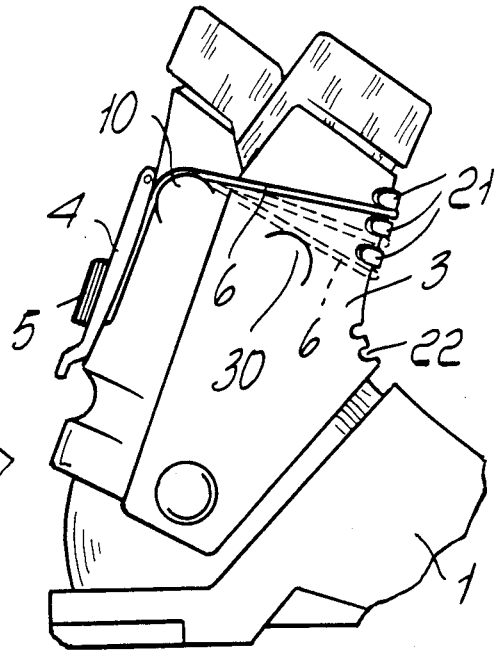
FIG. 1 is a partial lateral elevation view of a rear-entry ski boot with the closure means positioned for the obtainment of minimum flexibility.
Figure 3:
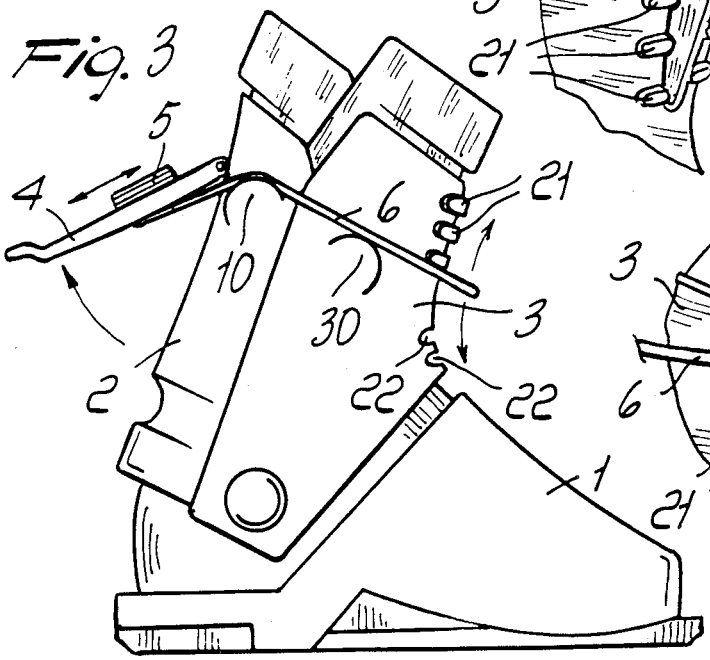
FIG. 3 is a schematic view of the ski boot with the closure means in open position.
Figure 4:
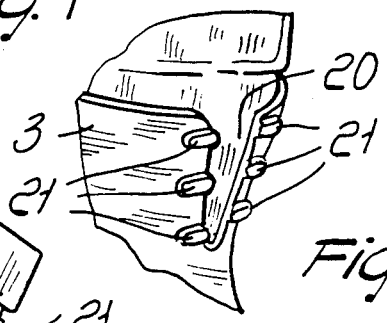
FIG. 4 is a perspective view of the detail of the slot used to adjust the flexibility.
Figure 5:
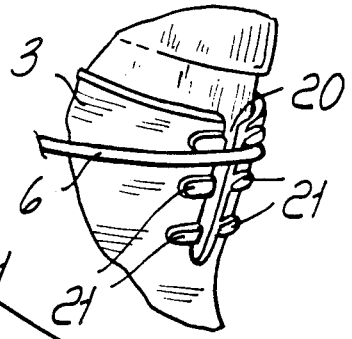
FIG. 5 is a view of the cable positioned to obtain the minimum flexibility.

With reference to the above cited figures, the rear-entry ski boot with a closure and flexibility adjustment device, according to the invention, comprises a shell 1 to which a rear quarter 2 and a front quarter 3 are pivotably coupled.

To the rear quarter 2 a lever 4 is articulated, with the possibility of rotating about an axis which is substantially horizontal, perpendicular to the longitudinal extension of the shell, and supports a cursor 5, variably positionable along the longitudinal extension of the lever, to which a cable 6 is connected which embraces the front quarter 3.

The cursor 5 can naturally be replaced by other per se known elements which can be used to vary the useful length of the cable 6.

Said cable 6 extends on rear transmission tabs 10 arranged symmetrically on the rear quarter 2, which in practice provide the support area and the rotation and sliding point for the cable 6.

The cable 6 transversely embraces the front quarter 3 so as to be able to perform the mutual closure of the quarters 2 and 3 upon tightening of the lever 4.

Furthermore, the closure means used for the mutual tightening of the quarters are also capable of simultaneously performing the adjustment of the flexibility of the quarter.

For this purpose, an upwardly open slot 20 is provided in the upper middle region of the front quarter 3, and is provided, at its edges, with transverse notches 21 which provide a plurality of engagement seats for the cable 6, variously positioned with respect to the longitudinal extension of the slot 20.

With this arrangement, by positioning the cable 6 at the lowermost notch and performing the closure of the rear lever 4, it is possible to achieve the maximum flexibility, together with the mutual closure of the quarters on one another, the flaps of the slot 20 being free to move apart during the flexing phase of the skier.

By varying the position of the cable 6 towards the notches proximate to the free edge of the front quarter 3, it is possible to achieve, together with the mutual closure of the quarters, also the progressive mutual approach of the flaps of the slot 20, which turns into an increasing resistance to a forward slant of the leg of the skier and thus in a progressively decreasing flexibility of the boot.

On the front quarter 3, below the notches 21, recesses 22 are provided which allow to extend the range of adjustment of the closure of the boot, without affecting the flexibility, which remains at the maximum value.

On the lateral parts of the front quarter 3, front transmission tabs may be provided, indicated by the reference numeral 30, on which the cable 6 unwinds, and which offer the possibility of further increasing the recovery of the cable, since they can be both engaged by the cable accommodated in the recesses 22 or eventually the cable 6 can engage only one front tab or none of them, accordingly varying the useful length of the cable for the closure.

From what has been described, it can thus be seen that the invention achieves the proposed aims, and in particular the fact is stressed that closure means are provided which are themselves capable of performing the adjustment of the flexibility, since they are removably engageable with seats defined by notches arranged along the longitudinal extension of the front slot provided on the front quarter, obtaining a greater or smaller spacing of the flaps of the slot and accordingly a smaller or greater flexibility for the boot.

Furthermore, the presence of the recesses provided in the lower part of the front quarter allows the possibility of obtaining a recovery of the cable 6 when it is desired simply and exclusively to perform the mutual closure of the quarters, without acting directly on the flexibility.

Another important aspect of the invention furthermore resides in the fact that the means used are always connected to the boot, since they are coupled to a lever articulated to the rear quarter which allows the possibility, with the cursor slideable on the lever itself, to adjust the useful length of the cable within a wide margin and accordingly the function which can be performed thereby.

The invention thus conceived is susceptible to numerous modifications and variations, all of which are within the scope of the inventive concept.

Moreover, all the details may be replaced by other technically equivalent elements.

In practice, the materials employed, so long as compatible with the specific use, as well as the dimensions and the contingent shapes, may be any according to the requirements.

I claim:

1. In combination, a rear entry ski boot and a closure and flexibility adjustment device, said ski boot comprising a shell, at least one front quarter, at least one rear quarter, locator means, and means for imparting flexibility to said front quarter, said device comprising at least one actuating element, adjustment means, and at least one tension element having at least one portion and at least one other portion, said front quarter and said rear quarter being pivotally connected to said shell, said actuating element being pivotally connected to said rear quarter, said adjustment means being shiftable on said actuating element, said locator means being rigidly associated with said front quarter, said means for imparting flexibility to said front quarter being adapted for at least partially intersecting said locator means, said one portion of said tension element being rigidly associated with said adjustment means, said other portion of said tension element embracing said front quarter and being removably accommodatable in at least one first position whereat said other portion interferes with said locator means and said means for imparting flexibility to said front quarter, and in at least one second position whereat said other portion interferes with said locator means and avoids interference with said means for imparting flexibility to said front quarter.

2. A combination according to claim 1, wherein said locator means comprise a plurality of notches, and wherein said means for imparting flexibility to said front quarter comprise at least one slot, said plurality of notches being rigidly associated with said front quarter, said slot intersecting at least some of said plurality of notches.

3. A combination according to claim 2, wherein said slot defines a substantially divaricated conformation when said other portion of said tension element is located in said second position for imparting flexibility to said front quarter.

4. A combination according to claim 2, wherein at least a portion of said slot defines a substantially closed conformation when said other portion of said tension element is located in said first position, for adjusting flexibility of said front quarter.

5. A combination according to claim 1, wherein said tension element defines a working length dimension, said adjustment means being operatable for selectively adjusting said working length dimension of said tension element, said actuating element being adapted for tensioning said tension element when said other portion is located at said first position for fastening together said front quarter and said rear quarter, and for effecting flexibility adjustment of said front quarter through interference said means for imparting flexibility to said front quarter.

6. A combination according to claim 5, wherein said actuating element is further adapted for tensioning said tension element with said other portion is located at said second position for fastening together said front quarter and said rear quarter and for avoiding interference with said means for imparting flexibility to said front quarter.

7. A combination according to claim 2, wherein said locator means further comprise recesses, said front quarter having a lower portion, said recesses being defined on said lower portion of said front quarter, said second position being defined at said recesses.

8. In combination, a rear entry ski boot and a closure and flexibility adjustment device, said ski boot comprising a shell, at least one front quarter having an upper portion and a lower portion, at least one rear quarter, a first plurality of locators, a second plurality of locators and at least one slot, said device comprising at least one actuating lever, and at least one cable having at least one portion and at least one other portion, said front quarter and said rear quarter being pivotally connected to said shell, said actuating lever being pivotally connected to said rear quarter, said first plurality of locators being rigidly associated with said upper portion of said front quarter, said second plurality of locators being rigidly associated with said lower portion of said front quarter, said slot being adapted for imparting flexibility to said front quarter and at least partially intersecting at least said first plurality of locators, said one portion of said cable being connected to said actuation lever, said other portion of said cable embracing said front quarter and being releasably fastenable in at least one first position whereat said other portion cooperates with said first plurality of locators and said slot, and in at least one second position whereat said other portion cooperates with said second plurality of locators and avoids interference with said slot.

9. A combination according to claim 8, wehrein said front quarter has a degree of flexibility, said actuating lever being adapted for tensioning said cable when said other portion is located at said first position for fastening together said front quarter and said rear quarter, and for simultaneously adjusting said degree of flexibility of said front quarter through interference with said slot.

10. A combination according to claim 9, wherein said actuating lever is further adapted for tensioning said cable when said other portion is located at said second position for fastening together said front quarter and said rear quarter for permitting use of said ski boot without adjustment of said degree of flexibility of said front quarter by avoiding interference of said cable with said slot.

11. A combination according to claim 8, wherein said first plurality of locators comprises a plurality of notches, and wherein said second plurality of locators comprises a plurality of recesses, said slot intersecting at least some of said plurality of notches.

12. A combination according to claim 8, wherein said cable defines a working length dimension, said device further comprising cable adjustment means, said cable adjustment means being operatively interposed between said actuating lever and said at least one portion of said cable and adapted for permitting adjustment of said working length dimension.

13. A combination according to claim 8, wherein said first plurality of locators defines a longitudinal locator extension, and wherein said slot defines a longitudinal slot extension, said other portion of said cable being adapted for embracing said front quarter, and for selectively intersecting said longitudinal locator extension and said longitudinal slot extension at a predetermined point, said predetermined point being selected according to desired flexibility characteristics of said front quarter.

14. A combination according to claim 8, wherein said slot defines a substantially divaricated conformation when said other portion of said cable is located in said second position for imparting flexibility to said upper portion of said front quarter.

15. A combination according to claim 8, wherein at least a portion of said slot defines a substantially closed conformation when said other portion of said cable is located in said first position, for adjusting flexibility of said upper portion of said front quarter.

* * * * *